US012364281B2

(12) United States Patent
Park et al.

(10) Patent No.: US 12,364,281 B2
(45) Date of Patent: Jul. 22, 2025

(54) AEROSOL GENERATION APPARATUS

(71) Applicant: KT&G CORPORATION, Daejeon (KR)

(72) Inventors: Sang Kyu Park, Hwaseong-si (KR); Seung Won Lee, Gwangmyeong-si (KR); Jong Sub Lee, Seongnam-si (KR)

(73) Assignee: KT&G CORPORATION, Daejeon (KR)

( * ) Notice: Subject to any disclaimer, the term of this patent is extended or adjusted under 35 U.S.C. 154(b) by 990 days.

(21) Appl. No.: 17/050,520

(22) PCT Filed: Oct. 24, 2019

(86) PCT No.: PCT/KR2019/014059
§ 371 (c)(1),
(2) Date: Oct. 26, 2020

(87) PCT Pub. No.: WO2020/122409
PCT Pub. Date: Jun. 18, 2020

(65) Prior Publication Data

US 2021/0112870 A1 Apr. 22, 2021

(30) Foreign Application Priority Data

Dec. 11, 2018 (KR) ..... 10-2018-0159115

(51) Int. Cl.
*A24F 40/46* (2020.01)
*A24F 40/20* (2020.01)
(Continued)

(52) U.S. Cl.
CPC ..... *A24F 40/46* (2020.01); *A24F 40/20* (2020.01); *A24F 40/51* (2020.01); *A24F 40/57* (2020.01); *A24F 40/465* (2020.01)

(58) Field of Classification Search
CPC ..... A24F 40/46; A24F 40/465; A24F 40/51; A24F 40/57
See application file for complete search history.

(56) References Cited

U.S. PATENT DOCUMENTS 11,033,055 B2 6/2021 Fraser et al.
2014/0373856 A1 12/2014 Zuber et al.
(Continued)

FOREIGN PATENT DOCUMENTS

CN 101432608 A 5/2009
CN 103987286 A 8/2014
(Continued)

OTHER PUBLICATIONS

Extended European Search Report dated Oct. 21, 2021 from the European Patent Office in Application No. 19896241.7.
(Continued)

*Primary Examiner* — Michael H. Wilson
*Assistant Examiner* — Courtney G Culbert
(74) *Attorney, Agent, or Firm* — Sughrue Mion, PLLC

(57) ABSTRACT

An aerosol generating device includes an accommodator for accommodating a cigarette through an opening formed at an end of the accommodator, a first susceptor located in the accommodator, a second susceptor disposed a predetermined distance away from the first susceptor, a coil that generates an alternating magnetic field for the first and second susceptors to generate heat, and a temperature sensor arranged proximate to the second susceptor to measure a temperature profile of the second susceptor. The temperature profile of the second susceptor corresponds to a temperature profile of the first susceptor, and a temperature of the first susceptor is determined based on the temperature profile of the second susceptor.

11 Claims, 5 Drawing Sheets

(51) Int. Cl.

| | |
|---|---|
| ***A24F 40/465*** | (2020.01) |
| ***A24F 40/51*** | (2020.01) |
| ***A24F 40/57*** | (2020.01) |

(56) References Cited

U.S. PATENT DOCUMENTS

| | | | | |
|---|---|---|---|---|
| 2016/0022930 | A1 | 1/2016 | Greim et al. | |
| 2016/0309784 | A1 | 10/2016 | Silvestrini et al. | |
| 2016/0374397 | A1 | 12/2016 | Jordan et al. | |
| 2017/0055580 | A1 | 3/2017 | Blandino et al. | |
| 2017/0071250 | A1 | 3/2017 | Mironov et al. | |
| 2018/0125119 | A1 | 5/2018 | Cadieux et al. | |
| 2018/0184713 | A1 | 7/2018 | Mironov et al. | |
| 2018/0192700 | A1 | 7/2018 | Fraser et al. | |
| 2018/0192701 | A1* | 7/2018 | Stoner | A61M 15/0025 |
| 2018/0310622 | A1 | 11/2018 | Mironov et al. | |
| 2018/0325179 | A1* | 11/2018 | Li | H05B 1/0252 |
| 2019/0008210 | A1 | 1/2019 | Mironov et al. | |
| 2019/0142066 | A1* | 5/2019 | Gill | A24F 40/51 131/329 |
| 2019/0208813 | A1 | 7/2019 | Rojo-Calderon et al. | |
| 2019/0230987 | A1* | 8/2019 | Wu | H05B 6/36 |
| 2019/0313698 | A1 | 10/2019 | Kuczaj | |
| 2020/0054068 | A1 | 2/2020 | Blandino et al. | |
| 2020/0352224 | A1 | 11/2020 | Plojoux et al. | |

FOREIGN PATENT DOCUMENTS

| | | | |
|---|---|---|---|
| CN | 104470386 | A | 3/2015 |
| CN | 105407750 | A | 3/2016 |
| CN | 106858723 | A | 6/2017 |
| CN | 107510097 | A | 12/2017 |
| CN | 207766584 | U | 8/2018 |
| EP | 3357359 | A2 | 8/2018 |
| EP | 3357359 | A3 | 8/2018 |
| KR | 10-2018-0033295 | A | 4/2018 |
| KR | 10-2018-0040522 | A | 4/2018 |
| KR | 10-2018-0069895 | A | 6/2018 |
| KR | 10-2018-0088389 | A | 8/2018 |
| KR | 10-2018-0124739 | A | 11/2018 |
| RU | 2 645 205 | C1 | 2/2018 |
| RU | 2 670 534 | C1 | 10/2018 |
| WO | 2007/124891 | A1 | 11/2007 |
| WO | 2017/191176 | A1 | 11/2017 |
| WO | 2018/002085 | A1 | 1/2018 |

OTHER PUBLICATIONS

Communication dated Sep. 14, 2021 from the Japanese Patent Office in Application No. 2020-544256.

Chinese Office Action dated Feb. 22, 2023 in Chinese Application No. 201980026969.7.

Office Action dated Nov. 29, 2021, issued by the Federal Service for Intellectual Property in Russian Application No. 2021113698/03.

Korea office action for Korean application KR10-2018-0159115 dated Jun. 18, 2020.

International Search Report for PCT/KR2019/014059 dated Feb. 5, 2020.

Office Action issued Oct. 19, 2023 in Chinese Application No. 201980026969.7.

* cited by examiner

AEROSOL GENERATION APPARATUS

CROSS-REFERENCE TO RELATED APPLICATIONS

This application is a National Stage of International Application No. PCT/KR2019/014059 filed Oct. 24, 2019, which claims priority under U.S.C. § 119(a) to Korean Patent Application No. 10-2018-0159115 filed on Dec. 11, 2018.

TECHNICAL FIELD

One or more embodiments of the present disclosure relate to an aerosol generating device and a method of generating an aerosol, and more particularly, to an aerosol generating device that determines a temperature of a first susceptor based on a temperature profile of a second susceptor that corresponds to a temperature profile of the first susceptor, and a method of generating an aerosol.

BACKGROUND ART

Recently, there is growing demand for a method of generating aerosol by heating a cigarette medium in a cigarette rather than by combusting the cigarette. Accordingly, studies on a heating-type cigarette and a heating-type aerosol generating device have been actively conducted.

In general, a heater formed of an electric resistor is arranged inside or outside a cigarette accommodated in an aerosol generating device, and electric power is supplied to the heater to heat the cigarette. However, heating methods different from the above-described existing method have recently been proposed. Research has actively been conducted on a method of generating an aerosol within an aerosol generating device, in which, by supplying current to a coil included in an aerosol generating device and applying a magnetic field from outside to a susceptor, the susceptor is heated to generate an aerosol.

The susceptor that generates heat resulting from the magnetic field is included inside or outside a cigarette. In most induction heating type aerosol generating devices, a coil is disposed separately from a susceptor, and a temperature of the susceptor is measured in an indirect manner has been disclosed. For example, in order to measure a temperature of a susceptor, the current, voltage, and the like flowing through a coil are measured to estimate the temperature of the susceptor. Also, the temperature of the susceptor is raised to a specific temperature by the Curie temperature.

However, when the above-described methods of measuring a temperature of a susceptor are used, accuracy of the measured temperature is low due to various factors caused by the state of the susceptor and surrounding components. Accordingly, it is difficult to control the temperature of the susceptor. In addition, when the temperature of the susceptor is raised to a specific temperature by the Curie temperature, it is not possible to set a temperature other than the specific temperature as a target temperature.

Therefore, one or more embodiments of the present disclosure provide an aerosol generating device that is able to improve the accuracy of the measured temperature of the susceptor, easily control the temperature of the susceptor, and effectively respond to a change in the temperature of the susceptor.

DESCRIPTION OF EMBODIMENTS

Technical Problem

One or more embodiments of the present disclosure provide an aerosol generating device that determines a temperature of a first susceptor based on a temperature profile of a second susceptor that corresponds to a temperature profile of the first susceptor, and a method of generating an aerosol.

Additional aspects will be set forth in part in the description which follows and, in part, will be apparent from the description, or may be learned by the practice of the presented embodiments.

Solution to Problem

According to an aspect of the present disclosure, an aerosol generating device includes: an accommodator for accommodating a cigarette through an opening formed at an end of the accommodator; a first susceptor located in the accommodator; a second susceptor disposed a predetermined distance away from the first susceptor; a coil that generates an alternating magnetic field for the first susceptor and the second susceptor to generate heat; and a temperature sensor disposed proximate to the second susceptor to measure a temperature profile of the second susceptor, wherein the temperature profile of the second susceptor corresponds to a temperature profile of the first susceptor, and a temperature of the first susceptor is determined through the temperature profile of the second susceptor.

The coil may be wound along a side wall of the accommodator, and the second susceptor may be disposed a predetermined distance away from the first susceptor toward the other end of the accommodator.

The second susceptor may be disposed in a compartment located at the other end of the accommodator, and the coil may extend toward the compartment to wind around a side wall of the compartment together.

The second susceptor may be made of the same material as the first susceptor.

The first susceptor and the second susceptor may have the same longitudinal axis.

The temperature sensor may be disposed a predetermined distance away from the second susceptor.

The temperature sensor may be disposed to be in contact with the second susceptor.

The temperature sensor may include an infrared sensor, a negative temperature coefficient of resistance (NTC) sensor, or a positive temperature coefficient of resistance (PTC) sensor.

According to another aspect of the present disclosure, an aerosol generating device may further include a controller that determines a temperature of the first susceptor based on a temperature profile of the second susceptor.

The controller may make the temperature profile of the second susceptor correspond to a temperature profile of the first susceptor through a predetermined off-set value.

According to another aspect of the present disclosure, an aerosol generating device may further include a power supply for supplying electric power to the coil.

According to another aspect of the present disclosure, a method of generating an aerosol, the method includes: generating an alternating magnetic field in a coil; generating heat in the first and second susceptors resulting from the magnetic field; and determining a temperature of the first susceptor through a temperature profile of the second susceptor.

A computer-readable recording medium has recorded thereon a computer program for executing the method of generating an aerosol according to another aspect of the present disclosure.

Advantageous Effects of Disclosure

A temperature of a first susceptor may be estimated by measuring a temperature of a second susceptor because it is difficult to measure the temperature of the first susceptor into which a cigarette is inserted. Since the temperature of the second susceptor may be measured to estimate and determine the temperature of the first susceptor, an aerosol generating device may easily control the temperature of the first susceptor, thus heat transferred from the first susceptor to the cigarette may be effectively controlled. As such, the flavor of an aerosol generated from the cigarette may be rich and consistent.

BEST MODE

According to an aspect of the present disclosure, an aerosol generating device includes: an accommodator for accommodating a cigarette through an opening formed at an end of the accommodator; a first susceptor located in the accommodator; a second susceptor disposed a predetermined distance away from the first susceptor; a coil that generates an alternating magnetic field for the first susceptor and the second susceptor to generate heat; and a temperature sensor disposed proximate to the second susceptor to measure a temperature profile of the second susceptor, wherein the temperature profile of the second susceptor corresponds to a temperature profile of the first susceptor, and a temperature of the first susceptor is determined based on the temperature profile of the second susceptor.

MODE OF DISCLOSURE

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in predetermined cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Terms including an ordinal number such as "first" or "second" used in the specification may be used to describe various components. However, embodiments of the present disclosure are not limited thereto. The terms are used only for the purpose of distinguishing one component from other components.

Hereinafter, the present disclosure will be described in detail with reference to the accompanying drawings, in which embodiments of the present disclosure are shown such that those skilled in the art may easily work the present disclosure. The disclosure may, however, be embodied in many different forms and should not be construed as being limited to the embodiments set forth herein.

Figure 1A:
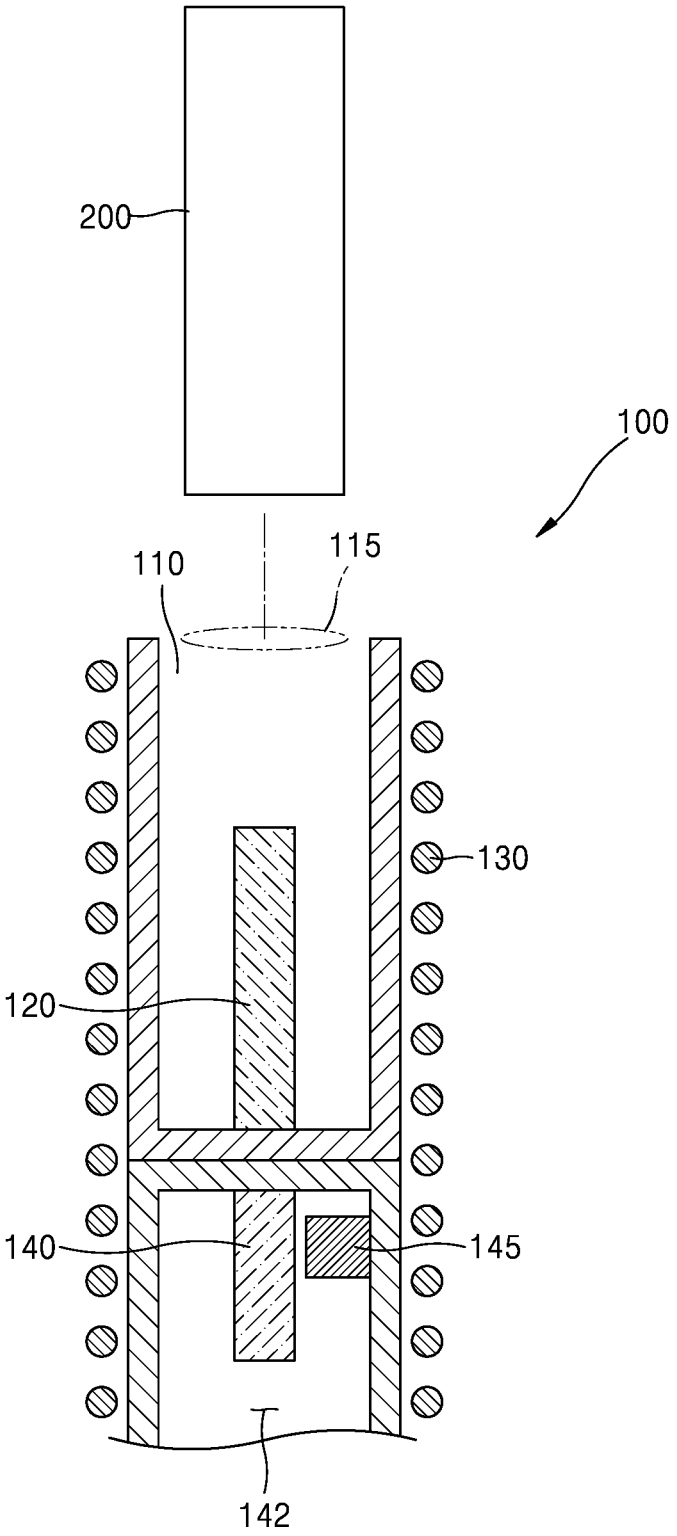
FIG. 1A is a cross-sectional view of a portion including an accommodator that accommodates a cigarette within an aerosol generating device, according to an embodiment of the present disclosure.
Figure 1B:
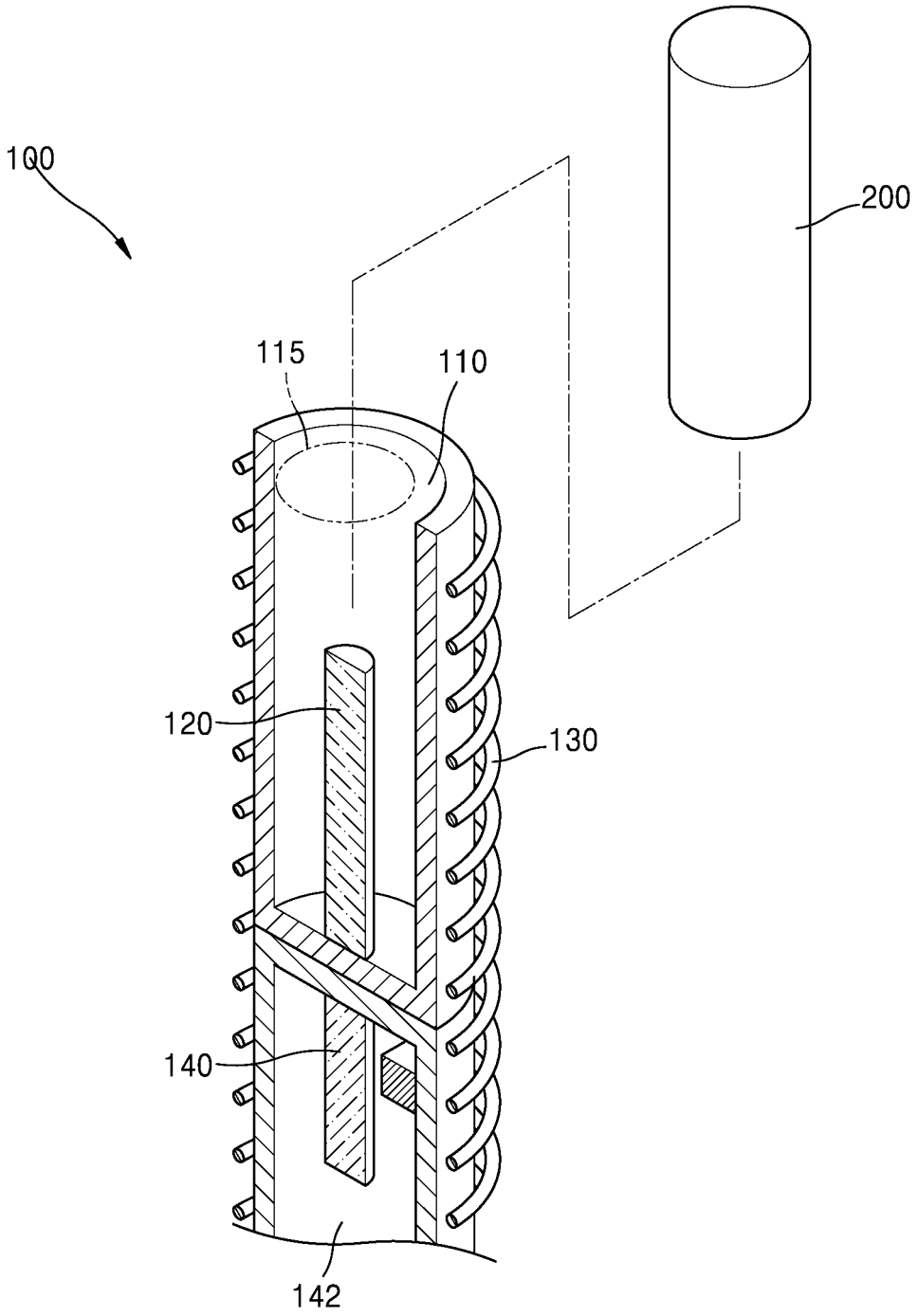
FIG. 1B is a perspective view of a portion of an aerosol generating device according to the embodiment illustrated in FIG. 1A.

FIG. 1A is a cross-sectional view of a portion including an accommodator 110 that accommodates a cigarette 200 within an aerosol generating device 100 according to an embodiment of the present disclosure, and FIG. 1B is a perspective view of a portion of the aerosol generating device 100 according to the embodiment illustrated in FIG. 1A.

The aerosol generating device 100 according to an embodiment will be described in greater detail with reference to FIGS. 1A and 1B.

The aerosol generating device 100 according to an embodiment of the present disclosure includes: the accommodator 110 for accommodating a cigarette through an opening 115 formed at an end of the accommodator 110; a first susceptor 120 located in the accommodator 110; a second susceptor 140 disposed a predetermined distance away from the first susceptor 120; a coil 130 that generates an alternating magnetic field for the first susceptor 120 and the second susceptor 140 to generate heat; and a temperature sensor 145 disposed proximate to the second susceptor 140 to measure a temperature profile of the second susceptor 140. The temperature profile of the second susceptor 140 corresponds to a temperature profile of the first susceptor 120, and a temperature of the first susceptor 120 is determined based on the temperature profile of the second susceptor 140.

The coil 130 may be wound along a side wall of the accommodator 110, and the second susceptor 140 may be disposed a predetermined distance away from the first susceptor 120 toward the other end of the accommodator 110.

An induction heating method may refer to a method of generating heat from the first susceptor 120 by applying an alternating magnetic field that periodically changes its direction to the first susceptor 120 that generates heat resulting from an external magnetic field. The aerosol generating device 100 may heat the cigarette 200 by the induction heating method to generate an aerosol.

The aerosol generating device 100 according to an embodiment may include the accommodator 110 for accommodating the cigarette 200 through the opening 115 formed at an end of the accommodator 110. The opening 115 formed at the end of the accommodator 110 such that the cigarette 200 may be inserted into the accommodator 110 through the opening 115.

The first susceptor 120 may be located in the accommodator 110. The first susceptor 120 may be inserted into the cigarette 200 to heat the cigarette 200. An end portion of the first susceptor 120 may be in contact with a bottom surface of the accommodator 110, and the other end portion of the first susceptor 120 may extend in a direction away from the bottom surface. For example, the first susceptor 120 may have an elongated shape extending from the bottom surface of the accommodator 110 toward an end of the accommodator 110. The first susceptor 120 may have a cylindrical or prismatic shape, but the shape of the first susceptor 120 is not limited thereto. The shape, size, material, and the like of the first susceptor 120 may be changed if necessary.

The aerosol generating device 100 according to an embodiment may include the second susceptor 140 disposed a predetermined distance away from the first susceptor 120. For example, the second susceptor 140 may be disposed a predetermined distance away from the first susceptor 120 toward the other end of the accommodator 110.

The temperature profile of the second susceptor 140 may correspond to the temperature profile of the first susceptor 120. The second susceptor 140 may generate heat at the same time as the first susceptor 120, and the temperature profile of the second susceptor 140 may correspond to the temperature profile of the first susceptor 120. In other words, the temperature profile of the second susceptor 140 and the temperature profile of the first susceptor 120 have a predetermined correlation, and the temperature profile of the first susceptor 120 may be estimated through the temperature profile of the second susceptor 140 based on the predetermined correlation.

In that case, the correlation may indicate an off-set which is a difference between the temperature of the first susceptor 120 and a temperature of the second susceptor 140, and the off-set between the temperature profile of the first susceptor 120 and the temperature profile of the second susceptor 140 will be described later with reference to FIGS. 3A and 3B.

The aerosol generating device 100 according to an embodiment may include the coil 130 that generates an alternating magnetic field for the first susceptor 120 and the second susceptor 140 to generate heat. In that case, the coil 130 may be wound along a side wall of the accommodator 110.

For example, a portion of the side wall of the accommodator 110 along which the coil 130 is wound may correspond to a length of the first susceptor 120 extending in the accommodator 110. That is, the coil 130 may be wound along the side wall of the accommodator 110 so that at least a portion of the first susceptor 120 is surrounded by the coil 130. As such, at least a portion of the first susceptor 120 may generate heat resulting from the magnetic field generated by the coil 130.

The coil 130 may be supplied with an alternating current by the aerosol generating device 100 and may generate an alternating magnetic field inside the coil 130. The first susceptor 120 and the second susceptor 140 may generate heat resulting from the alternating magnetic field that is generated by the coil 130, and the cigarette 200 inserted into the first susceptor 120 may be heated by heat generated from the first susceptor 120. As the cigarette 200 is heated by the first susceptor 120, the aerosol is generated from the cigarette 200 and a user may inhale the aerosol.

The greater an amplitude and frequency of the magnetic field applied to the first susceptor 120 and the second susceptor 140 become, the more thermal energy may be released from the first susceptor 120 and the second susceptor 140. Accordingly, the aerosol generating device 100 may apply the magnetic field to the first susceptor 120 such that the thermal energy is released from the first susceptor 120 to heat the first susceptor 120.

The second susceptor 140 may be arranged in a compartment 142 located at the other end of the accommodator 110, and the coil 130 may extend toward the compartment 142 to wind around a side wall of the compartment 142 as well.

The compartment 142 located at the other end of the accommodator 110 may form a space separate from the accommodator 110. For example, the compartment 142 may include a space separate from the accommodator 110 within the aerosol generating device 100, and the second susceptor 140 may be arranged in the compartment 142. An upper wall of the compartment 142 may be in contact with the bottom surface of the accommodator 110. The upper wall of the compartment 142 and the bottom surface of the accommodator 110 may be formed integrally to form a wall that separates the accommodator 110 and the compartment 142 from each other.

The second susceptor 140 may be arranged in the compartment 142, and the second susceptor 140 may extend in a direction away from the upper wall in the compartment 142. For example, the second susceptor 140 may have an elongated shape extending in a direction away from the upper wall of the compartment 142. However, the shape of the second susceptor 140 is not limited thereto, and the shape, size, material, and the like of the second susceptor 140 may be changed if necessary.

The aerosol generating device 100 according to an embodiment includes the temperature sensor 145 arranged proximate to the second susceptor 140 to measure the temperature profile of the second susceptor 140.

The temperature sensor 145 may be arranged in the aerosol generating device 100 to measure the temperature of the second susceptor 140, and the temperature sensor 145 may be configured not to be affected by the magnetic field generated by the coil 130.

The temperature sensor 145 may be arranged proximate to the second susceptor 140. For example, the temperature sensor 145 may be arranged in the compartment 142 together with the second susceptor 140, and may be mounted on an upper wall or side wall of the compartment 142. In that case, the temperature sensor 145 may be electrically connected to the second susceptor 140.

The temperature sensor 145 may measure the temperature of the second susceptor 140 indirectly or directly. When the temperature sensor 145 measures the temperature of the second susceptor 140 indirectly (i.e., in a non-contact way), the temperature sensor 145 may be arranged a predetermined distance away from the second susceptor 140. In that case, a predetermined distance between the temperature sensor 145 and the second susceptor 140 may be decided such that the temperature sensor 145 may be able to measure the temperature of the second susceptor 140 in the compartment 142.

In this case, the temperature sensor 145 may include an infrared (IR) sensor. However, embodiments of the present disclosure are not limited thereto, and the temperature sensor 145 may include another type of sensor capable of measuring the temperature of the second susceptor 140 at a predetermined distance.

If the temperature of the second susceptor 140 is to be measured indirectly, the temperature sensor 145 and the second susceptor 140 do not need to contact each other. As such, the temperature sensor 145 may be flexibly arranged in the aerosol generating device 100, which simplifies a configuration of the aerosol generating device 100.

If the temperature sensor 145 is to measure the temperature of the second susceptor 140 directly (i.e., by contact), the temperature sensor 145 may be arranged to be in contact with the second susceptor 140. In this case, the temperature sensor 145 may include a resistance temperature detector (RTD) sensor, a negative temperature coefficient of resistance (NTC) sensor, or a positive temperature coefficient of resistance (PTC) sensor. As long as the temperature sensor 145 is able to measure the temperature of the second susceptor 140 by contact, types of the temperature sensor 145 are not limited thereto.

In the case of measuring the temperature of the second susceptor 140 directly, the temperature sensor 145 and the second susceptor 140 need to be directly connected to each other. As the temperature of the second susceptor 140 is measured while the temperature sensor 145 and the second susceptor 140 are directly connected to each other, it is possible to measure the temperature of the second susceptor 140 in a more accurate and faster manner. The temperature profile of the second susceptor 140 may be recorded and quantified based on the temperature measured by the temperature sensor 145.

As the temperature profile of the second susceptor 140 is recorded and quantified, the temperature profile of the first susceptor 120 may be estimated, because the temperature profile of the second susceptor 140 corresponds to the temperature profile of the first susceptor 120.

In other words, since it is difficult to directly measure the temperature of the first susceptor 120 into which the cigarette 200 is inserted, the temperature of the first susceptor 120 may be estimated by measuring the temperature of the second susceptor 140 instead of the first susceptor 120. By estimating and determining the temperature of the first susceptor 120 based on the temperature of the second susceptor 140, the aerosol generating device 100 may control the temperature of the first susceptor 120 heat transferred from the first susceptor 120 to the cigarette 200 in an easy and efficient manner. Accordingly, the flavor of the aerosol generated from the cigarette 200 may become rich and consistent.

The second susceptor 140 may be made of the same material as the first susceptor 120 within the aerosol generating device 100, according to an embodiment. As such, the second susceptor 140 and the first susceptor 120 may have the same thermal characteristics.

For example, if the first susceptor 120 and the second susceptor 140 are provided with the same magnetic field for the same length of time, the temperature rise of the second susceptor 140 may be equal to that of the first susceptor 120. In that case, a heating rate of the second susceptor 140 may be equal to a heating rate of the first susceptor 120.

As the second susceptor 140 and the first susceptor 120 have the same thermal characteristics, the temperature profile of the second susceptor 140 and the temperature profile of the first susceptor 120 may be the same. Therefore, the temperature of the second susceptor 140 may be measured to determine the temperature profile of the first susceptor 120.

The first susceptor 120 and the second susceptor 140 may have the same longitudinal axis within the aerosol generating device 100, according to an embodiment. That is, the first susceptor 120 and the second susceptor 140 may be disposed the same distance away from an outer periphery of the coil 130 to accommodate the same magnetic field generated by the coil 130.

For example, referring to FIGS. 1A and 1B, the first susceptor 120 and the second susceptor 140 may be arranged in parallel with a longitudinal axis of the aerosol generating device 100, and a central axis of the coil 130, the longitudinal axis of the first susceptor 120, and the longitudinal axis of the second susceptor 140 may all coincide with each other.

Figure 2:
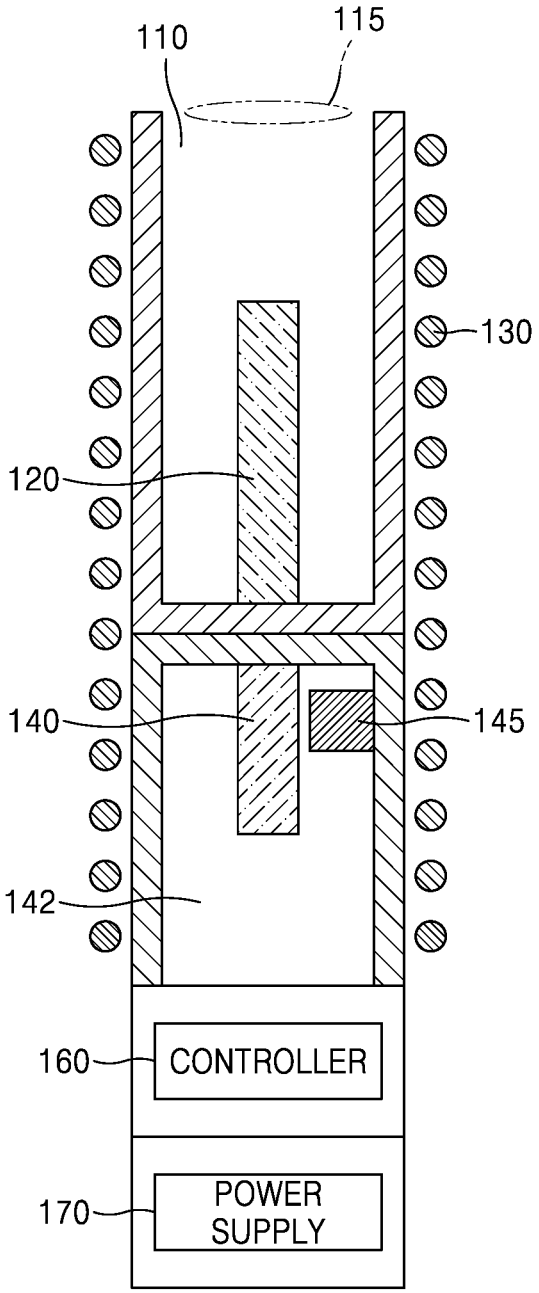
FIG. 2 is a cross-sectional view of an aerosol generating device further including a controller and a power supply, according to another embodiment of the present disclosure.

FIG. 2 is a cross-sectional view of the aerosol generating device 100 further including a controller 160 and a power supply 170, according to another embodiment of the present disclosure.

The aerosol generating device 100 according to another embodiment may further include the controller 160 that determines a temperature of the first susceptor 120 based on a temperature profile of the second susceptor 140, and the power supply 170 that supplies electric power to the coil 130.

The aerosol generating device 100 according to the present embodiment includes the components of the aerosol generating device 100 according to the previously-described embodiment. Since a configuration and effect of components of the aerosol generating device 100 according to the present embodiment are the same as the above descriptions, redundant detailed descriptions will be omitted.

The controller 160 may control electric power supplied to the coil 130. The controller 160 may determine a temperature profile of the first susceptor 120 based on the temperature profile of the second susceptor 140. The controller 160 may make the temperature profile of the second susceptor 140 correspond to the temperature profile of the first susceptor 120 through a predetermined off-set value.

The second susceptor 140 may be configured such that the temperature profile of the second susceptor 140 corresponds to the temperature profile of the first susceptor 120. Accordingly, the temperature profile of the second susceptor 140 and the temperature profile of the first susceptor 120 have a predetermined correlation, and the temperature profile of the first susceptor 120 may be estimated through the temperature profile of the second susceptor 140 by the predetermined correlation. In that case, the correlation may be an off-set which is a difference between the temperature of the first susceptor 120 and a temperature of the second susceptor 140.

Figure 3A:
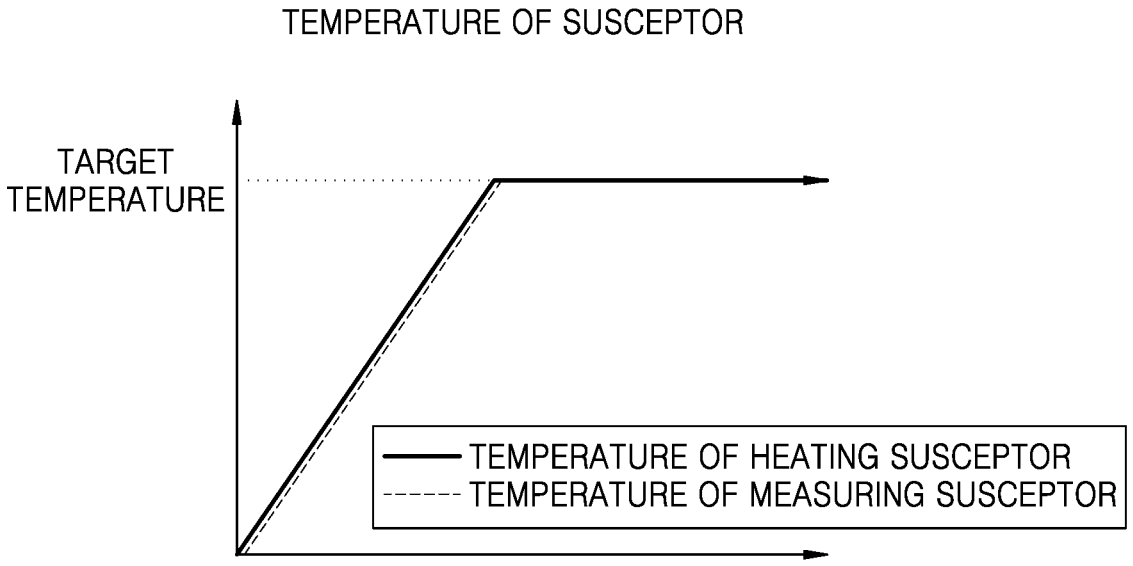
FIG. 3A is a diagram showing that there is no off-set value between a second susceptor and a first susceptor when a temperature of the first susceptor is determined based on a temperature profile of the second susceptor within an aerosol generating device, according to another embodiment of the present disclosure.

FIG. 3A is a diagram showing that there is no off-set value between the second susceptor 140 and the first susceptor 120, according to another embodiment of the present disclosure. FIG. 3B is a diagram showing that there is an off-set value between the second susceptor 140 and the first susceptor 120, according to another embodiment of the present disclosure.

A correlation between a temperature profile of the first susceptor 120 and the temperature profile of the second susceptor 140 may be described in greater detail with reference to FIGS. 3A and 3B.

Referring to FIG. 3A, the temperature profile of the first susceptor 120 and the temperature profile of the second susceptor 140 are shown in the case where there is no off-set.

In this case, the controller 160 may determine the temperature profile of the first susceptor 120 based on the temperature profile of the second susceptor 140, and correction through the off-set value is not necessary. In other words, the controller 160 may measure a temperature of the second susceptor 140 and estimate the temperature of the first susceptor 120 to be the measured temperature.

In the case where there is no off-set between the temperature profile of the first susceptor 120 and the temperature profile of the second susceptor 140, the first susceptor 120 and the second susceptor 140 may be made of the same material. However, embodiments of the present disclosure are not limited thereto.

Figure 3B:
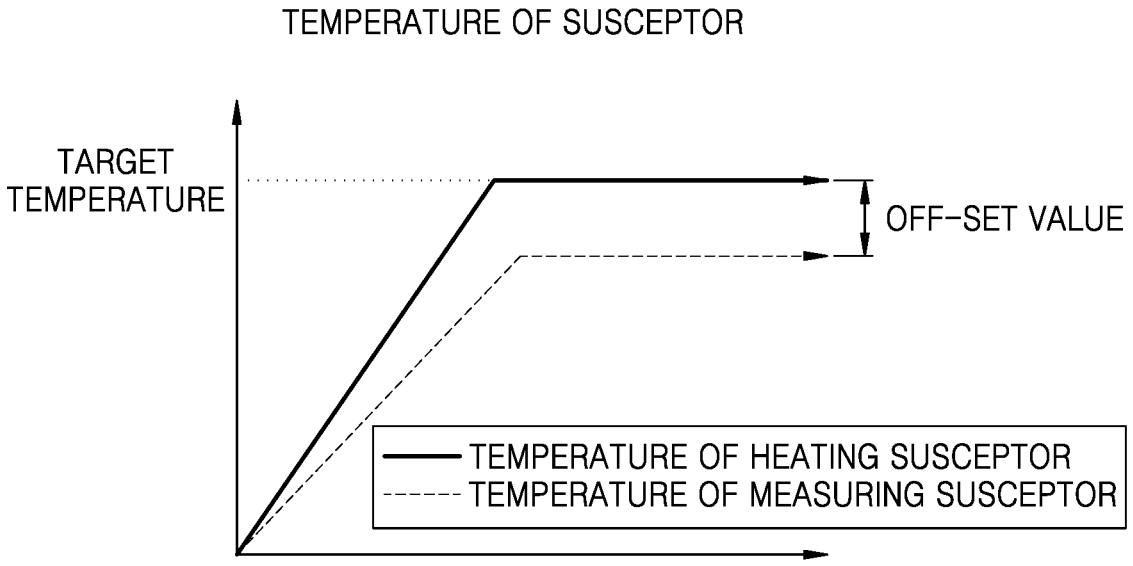
FIG. 3B is a diagram showing that there is an off-set value between a second susceptor and a first susceptor when a temperature of the first susceptor is determined based on a temperature profile of the second susceptor within an aerosol generating device, according to another embodiment of the present disclosure.

Referring to FIG. 3B, the temperature profile of the first susceptor 120 and the temperature profile of the second susceptor 140 are shown in the case where an off-set exists. When there is an off-set between the temperature profile of the first susceptor 120 and the temperature profile of the second susceptor 140, the off-set value may be added to the temperature of the second susceptor 140 to estimate the temperature of the first susceptor 120.

In that case, the off-set may be a difference between the temperature of the first susceptor 120 and the temperature of the second susceptor 140. The off-set value is represented as a positive number in FIG. 3B. However, embodiments of the present disclosure are not limited thereto, and the off-set value may be a negative number. The off-set value may be increased in proportion to the temperature of the second susceptor 140, and may be constant at a target temperature.

When there is an off-set value between the temperature profile of the first susceptor 120 and the temperature profile of the second susceptor 140, if the temperature of the second susceptor 140 is to be measured to determine the temperature of the first susceptor 120, correction through the off-set value may be necessary. The controller 160 may store the off-set values according to the temperatures of the second susceptor 140, and then may determine the temperature of the first susceptor 120 based on the temperature of the second susceptor 140.

The estimating of the temperature of the first susceptor 120 through the off-set value between the second susceptor 140 and the first susceptor 120 is not limited to the present embodiment and may be used in various ways. If it is difficult to measure a temperature of a certain component because an external element is inserted into the component, the temperature of such component may be accurately measured by the above-described method.

The power supply 170 supplies electric power for the aerosol generating device 100 to operate. For example, the power supply 170 may supply electric power for the first susceptor 120 and the second susceptor 140 to be heated, and may supply electric power needed for the controller 160 to operate. The power supply 170 may also supply electric power needed for a display, sensor, motor, and the like installed within the aerosol generating device 100 to operate. However, embodiments of the present disclosure are not limited thereto. The power supply 170 may supply electric power to other components within the aerosol generating device 100.

The aerosol generating device 100 according to one or more embodiments of the present disclosure may measure the temperature of the second susceptor 140 arranged a predetermined distance away from the first susceptor 120 to determine the temperature of the first susceptor 120. Thus, malfunction of the aerosol generating device 100 may be prevented. Also, over-heating inside the aerosol generating device 100 may be prevented and the components within the aerosol generating device 100 may be safely protected.

In addition, since the temperature of the first susceptor 120 may be precisely estimated and determined, the temperature of the first susceptor 120 may be controlled properly. Therefore, the aerosol generating device 100 according to one or more embodiments of the present disclosure may efficiently control heat transferred from the first susceptor 120 to the cigarette 200, and provide a rich and consistent flavor of the aerosol generated from the cigarette 200.

According to another embodiment of the present disclosure, a method of generating an aerosol may include generating an alternate magnetic field in the coil 130, generating heat in the first and second susceptors resulting from the magnetic field, and determining a temperature of the first susceptor 120 based on a temperature profile of the second susceptor 140.

Since a configuration and effect of the method of generating an aerosol according to another embodiment are the same as the configuration and effect of the aerosol generating device according to an embodiment, redundant detailed descriptions will be omitted.

The above-described method may be written as a computer program and may be implemented on a general purpose digital computer that may execute the computer program using a computer-readable recording medium. In addition, the structure of data used in the above-described method may be recorded on a computer-readable recording medium through various means. The computer-readable recording medium includes a storage medium such as magnetic storage media (e.g., ROM, RAM, USB, floppy disk, hard disk, and the like) and optical reading media (e.g., CD-ROM, DVD, and the like).

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

What is claimed is:

1. An aerosol generating device comprising:

an accommodator configured to accommodate a cigarette through an opening formed at one end of the accommodator;

a first susceptor located in the accommodator;

a second susceptor located in a compartment forming a space between an inner wall of the compartment and the second susceptor, the second susceptor being disposed a predetermined distance away from the first susceptor in the space between the inner wall of the compartment and the second susceptor;

a coil configured to generate an alternating magnetic field for the first susceptor and the second susceptor to generate heat; and a temperature sensor arranged proximate to the second susceptor to measure a temperature profile of the second susceptor, wherein an upper wall of the compartment and a bottom surface of the accommodator form a wall that separates the accommodator and the compartment from each other, wherein the temperature profile of the second susceptor corresponds to a temperature profile of the first susceptor, wherein the aerosol generating device further comprises a controller configured to determine a temperature of the first susceptor based on the temperature profile of the second susceptor, and wherein the space between the inner wall of the compartment and the second susceptor surrounds the second susceptor in a radial direction from a center of the compartment to the inner wall of the compartment as well as along a longitudinal direction of the second susceptor.

2. The aerosol generating device of claim 1, wherein the coil is wound along a side wall of the accommodator, and the second susceptor is disposed the predetermined distance away from the first susceptor toward another end of the accommodator.

3. The aerosol generating device of claim 1, wherein the coil extends toward the compartment to surround a side wall of the compartment together.

4. The aerosol generating device of claim 1, wherein the second susceptor is made of a same material as the first susceptor.

5. The aerosol generating device of claim 1, wherein the first susceptor and the second susceptor have a same longitudinal axis.

6. The aerosol generating device of claim 1, wherein the temperature sensor is disposed a predetermined distance away from the second susceptor.

7. The aerosol generating device of claim 1, wherein the temperature sensor is arranged to be in contact with the second susceptor.

8. The aerosol generating device of claim 1, wherein the temperature sensor includes an infrared sensor, a negative temperature coefficient of resistance (NTC) sensor, or a positive temperature coefficient of resistance (PTC) sensor.

9. The aerosol generating device of claim 1, wherein the controller is further configured to make the temperature profile of the second susceptor correspond to the temperature profile of the first susceptor through a predetermined off-set value.

10. The aerosol generating device of claim 1, further comprising a power supply configured to supply electric power to the coil.

11. The aerosol generating device of claim 1, further comprising a recording medium, and wherein the controller is further configured to:

in the recording medium, record and quantify the temperature profile of the second susceptor based on a temperature measured by the temperature sensor; and estimate the temperature profile of the first susceptor based on the temperature profile of the second susceptor.

* * * * *